US006295832B1

(12) United States Patent
Kato et al.

(10) Patent No.: US 6,295,832 B1
(45) Date of Patent: Oct. 2, 2001

(54) RECEIVER TANK

(75) Inventors: Soichi Kato; Akihiko Takano, both of Saitama (JP)

(73) Assignee: Zexel Corporation, Tokyo (JP)

( * ) Notice: Subject to any disclaimer, the term of this patent is extended or adjusted under 35 U.S.C. 154(b) by 0 days.

(21) Appl. No.: 09/463,322

(22) PCT Filed: Jul. 27, 1998

(86) PCT No.: PCT/JP98/03338

§ 371 Date: Jan. 24, 2000

§ 102(e) Date: Jan. 24, 2000

(87) PCT Pub. No.: WO99/05464

PCT Pub. Date: Feb. 4, 1999

(30) Foreign Application Priority Data

Jul. 28, 1997 (JP) ..... 9-201504
Apr. 17, 1998 (JP) ..... 10-108115

(51) Int. Cl.[7] ..... F25B 39/04
(52) U.S. Cl. ..... 62/509; 62/512
(58) Field of Search ..... 62/509, 512

(56) References Cited

U.S. PATENT DOCUMENTS 5,896,754 * 4/1999 Balthazard et al. ..... 62/509
5,992,174 * 11/1999 Mittelstrass ..... 62/509
6,125,651 * 10/2000 Tack et al. ..... 62/512

FOREIGN PATENT DOCUMENTS 2-58667 4/1990 (JP) .
3-6262 1/1991 (JP) .
5-306857 11/1993 (JP) .
9-170854 6/1997 (JP) .

* cited by examiner

*Primary Examiner*—William Doerrler
*Assistant Examiner*—Mohammad M Ali
(74) *Attorney, Agent, or Firm*—Kanesaka & Takeuchi

(57) ABSTRACT

A receiver tank (2) formed into an airtight container having an inlet port (24) and an outlet port (25) for a refrigerant, wherein separates the refrigerant introduced in a gas-liquid mixture state is separated, and the separated liquid refrigerant is stored therein and discharged therefrom so to continuously supply it, and the airtight container is formed as a double tube of an inner tube (16) and an outer tube (17), which have their tops mutually communicated but their bottoms not; the inlet port is formed to communicate with the bottom portion of a passage formed between the two tubes; and the outlet port is formed at lower end portions of the inner and outer tubes to communicate with the interior of the inner tube. The structure of no communication between the outer tube and the inner tube was achieved by having a structure of fitting either of them with the other or by disposing a joint member. A structure for prevention of the inner tube from tilting is provided. And, airtightness is improved by forming a knurled portion on a contact portion of the members.

9 Claims, 11 Drawing Sheets

RECEIVER TANK

TECHNICAL FIELD

The present invention relates to a receiver tank used for a cooling cycle for automobiles.

BACKGROUND ART

Generally, a heat-exchanging medium condensing device, such as a layered heat exchanger, is known being used for a cooling cycle for automobiles. This heat exchanger has a receiver tank connected thereto in order to prevent the cooling performance from being degraded.

This receiver tank is a device for separating a heat-exchanging medium, which is heat-exchanged with outside air by the heat exchanger to become a state of two phases of gas and liquid, into gas and liquid phases and returning only the heat-exchanging medium in a single phase of liquid so to be circulated through a cooling cycle. Thus, since the receiver tank is connected, the heat-exchanging medium is separated into gas and liquid by the receiver tank so as to become the heat-exchanging medium in only a single liquid-phase without containing a gas medium.

And, the receiver tank is determined to have a predetermined inside volume so that a sufficient amount of liquefied refrigerant can be stored therein.

Accordingly, the receiver tank can secure a stable circulating amount of the refrigerant and prevent the cooling performance from being degraded regardless of any changes in operation settings caused by outside environmental conditions, users or the like.

Besides, the receiver tank is provided with a filter, a desiccant and the like to remove foreign substances and water contained in the medium by their functions, thereby circulating the heat-exchanging medium in a clean state.

Conventionally, this type of condenser for the cooling cycle has the receiver tank integrally attached to the header pipe as shown in, for example, Japanese Patent Laid-Open Publications No. Hei 2-267478 and No. Hei 4-320771.

And, there is also disclosed a condenser and the like which has the header pipe configured to have inner and outer double tubes, the heat-exchanging medium flows into one of the tubes and the cooling water flows into the other so to simultaneously provide the function of the header pipe and that of the receiver tank as described in Japanese Utility Model Laid-Open Publication No. Hei 5-46511.

But, there was a disadvantage that when a separate receiver tank is mounted on the header pipe of the heat exchanger, a ventilation area of the heat exchanger was decreased due to the receiver tank, lowering the performance of the heat exchanger.

Specifically, such receiver tanks as described above retain a filter, a desiccant and the like therein in order to separate the heat-exchanging medium which consists of the two phases of gas and liquid into these two phases, and need a certain level of volume.

And these receiver tanks are generally mounted on the side of an ordinary header tank. But, since the heat exchanger mounted on a vehicle has a limited maximum front area due to its mounting space and must be made small for making a space for the receiver tank, it has a disadvantage that the heat-exchange performance is lowered.

Where the header pipe has a double tube structure so to have the function of the receiver tank, the cooling effect may be enhanced by mounting a cooling fan within the header pipe, and a volume therefor is required correspondingly. Therefore, there are disadvantages that the volume is increased inevitably, and not only the front area of the heat exchanger is limited in the same way as described above, but also the inside volume is limited.

Besides, a conventional liquid receiver is configured to retain a desiccant and the like within a single tube. The heat-exchanging medium in two phases of gas and liquid flows into the liquid receiver and separated into two phases of a gas medium and a liquid medium by the desiccant and the like within the liquid receiver. Therefore, there is a possibility that the separated mediums are re-mixed into the medium of two phases of gas and liquid depending on environmental conditions and the like.

Specifically, a passage of the medium formed within the liquid receiver has a simple and linear one-way form, and the desiccant or the like is disposed at midways in the passage. Therefore, there is a disadvantage that the performance of separating gas-liquid becomes insufficient.

In view of the disadvantages described above, it is an object of the present invention to provide a structure of the receiver tank by which only the liquid medium can be flowed again without using a special sealing member or the like after separating the heat-exchanging medium into the liquid medium and the gas medium so to be able to improve the cooling effect and which can be mounted on the header pipe at any angle.

DISCLOSURE OF THE INVENTION

The invention described in claim 1 is a receiver tank formed into an airtight container having an inlet port and an outlet port for a refrigerant, wherein the refrigerant introduced in a gas-liquid mixture state is separated into gas-liquid phases, the separated liquid refrigerant is stored therein and discharged therefrom so as to continuously supply it, characterized in that airtight container is formed as a double tube of inner and outer tubes, which have their tops mutually communicated but their bottoms not; the inlet port is formed to pierce through the outer tube so to communicate with a passage formed between the two tubes; and the outlet port is formed at a lower end portion of the double tube to pierce through the outer and the inner tubes and also to communicate awith the interior of the inner tube.

Thus, the receiver tank of the present invention is formed of the double-tube and has the passage in a length sufficient to flow the refrigerant upward and downward formed within the double-tube. Therefore, the performance of separating the heat-exchanging medium, which is in the two phases of gas and liquid introduced through the inlet port, into gas and liquid can be improved, and the liquefied refrigerant can be stored in a lower part of the receiver tank where the two tubes are not communicated mutually.

Since the separated gas refrigerant can be held at the upper portion within the tank and the liquid refrigerant can be stored in the lower portion of the tank, the refrigerant can be prevented from being re-mixed with the two phases of gas and liquid without using a special sealing member or the like. And the performance of separating the refrigerant can be improved.

Besides, by changing the positions of the inlet port of the receiver tank and the communication hole of the header pipe as required, an angle of connection between the inlet port and the communication hole can be changed as desired to prevent the receiver tank from adversely effecting on the heat exchange due to the ventilation of the heat exchanger. And, the flexibility of the entire layout to be housed in a small space of a vehicle body or the like can be improved.

The invention described in claim 2 is the receiver tank according to claim 1, wherein a shoulder portion is formed at a lower inside portion of the outer tube, the bottom end of the inner tube is connected and sealed to the shoulder portion, and the outlet port is formed at a lower end portion of the outer tube.

Thus, where the airtight double tube structure is formed with the bottom end of the inner tube connected and sealed to the shoulder portion formed at the lower inside portion of the outer tube, the double tube structure is formed with the inner tube stably supported by the shoulder portion so that it is not displaced or tilted within the outer tube. And, the heat-exchanging medium introduced from the heat exchanger is separated to obtain the liquid refrigerant within the receiver tank having the double tube structure. The liquid refrigerant is stored in the lower portion of the airtight inner tube, and not to be mixed with the gas medium again and then discharged from the outlet port formed at the lower end portion of the outer tube so to be circulated in the cooling cycle. Thus, the condensing effect of the receiver tank can be improved.

The invention described in claim 3 is the receiver tank according to claim 1, wherein a shoulder portion is formed at a lower outside portion of the inner tube, the bottom end of the outer tube is connected and sealed to the shoulder portion, and the outlet port is formed on the inner tube at a portion thereof below the shoulder portion.

Thus, since the airtight double tube structure is formed by having the shoulder portion at the lower outside portion of the inner tube and tightly connecting and sealing the bottom end of the outer tube to the shoulder portion, the stable double tube structure free from displacement or tilting of the inner tube is formed. And, where the outlet port is formed on the inner tube below the shoulder portion, the heat-exchanging medium introduced from the heat exchanger is separated to have the liquid refrigerant within the receiver tank. The separated liquid refrigerant is stored in the lower end portion of the airtight inner tube, and not to be mixed with the separated gas medium, and discharged from the outlet port to be circulated in the cooling cycle again. Therefore, the condensing effect of the receiver tank can be improved.

The invention described in claim 4 is the receiver tank according to claim 1, wherein projections are formed on the outer tube of the double tube to protrude toward the inner tube so to come into contact with the inner tube.

The invention described in claim 5 is the receiver tank according to claim 1, wherein projections are formed on the inner tube of the two tubes to protrude toward the outer tube so to come into contact with the outer tube.

Thus, where the projections are formed on the outer tube to protrude toward the inner tube so to come into contact with the inner tube or formed on the inner tube to protrude toward the outer tube so to come into contact with the outer tube, the inner tube can be held within the outer tube by means of the projections with a predetermined space formed between the entire outer periphery of the inner tube and the inner periphery of the outer tube. Therefore, the double tube structure securing the stable passage can be configured.

The invention described in claim 6 is the receiver tank according to claim 1, wherein a joint member, which holds the inner and outer tubes and has an inlet port and an outlet port, is disposed at a lower portion of the double tube.

Thus, where the joint member which holds the inner and outer tubes and has the inlet and outlet ports is disposed, the shapes of the inner and outer tubes can be simplified. As a result, the manufacture of the receiver tank can be facilitated further.

The invention described in claim 7 is the receiver tank according to claim 1, wherein a contraction portion which is smaller than the outer diameter of the outer tube is formed at a lower end portion of the outer tube of the double tube, and a shoulder portion is formed on the inside periphery of the contraction portion so to engage with the end of the inner tube.

Where the receiver tank has a flat bottom, there is a problem that a pressure load within the receiver tank is applied to the bottom to swell it. But, where the contraction portion is formed on the bottom by the present invention, the pressure load applied to the bottom is eased by virtue of the contraction portion, and the pressure resistance can be improved.

The invention described in claim 8 is the receiver tank according to claim 2, 3 or 7, wherein a contact portion between the inner tube and the outer tube is in a pressure contact state, and a knurled portion is formed on either or both of the inner tube and the outer tube at the contact portion.

Thus, where the knurled portion is formed on either or both of the inner tube and the outer tube to provide the pressure contact state at the contact portion between the inner tube and the outer tube, the inner periphery of the outer tube is firmly fitted to the outer periphery of the inner tube, and the airtightness is improved.

The invention described in claim 9 is the receiver tank according to claim 6, wherein the joint member is in a pressure contact state at a contact portion of the inner and outer tubes which are held by the joint member, and the knurled portion is formed on any or all of the joint member, the inner tube and the outer tube at the contact portion.

Thus, where the knurled portion is formed on any or all of the joint member, the inner tube and the outer tube so to have the pressure contact state at their fitted portions, the fitted portions are firmly contacted, and the airtightness is improved.

BEST MODE FOR CARRYING OUT THE INVENTION

Embodiments of the present invention will be described with reference to the accompanying drawings.

Figure 1:
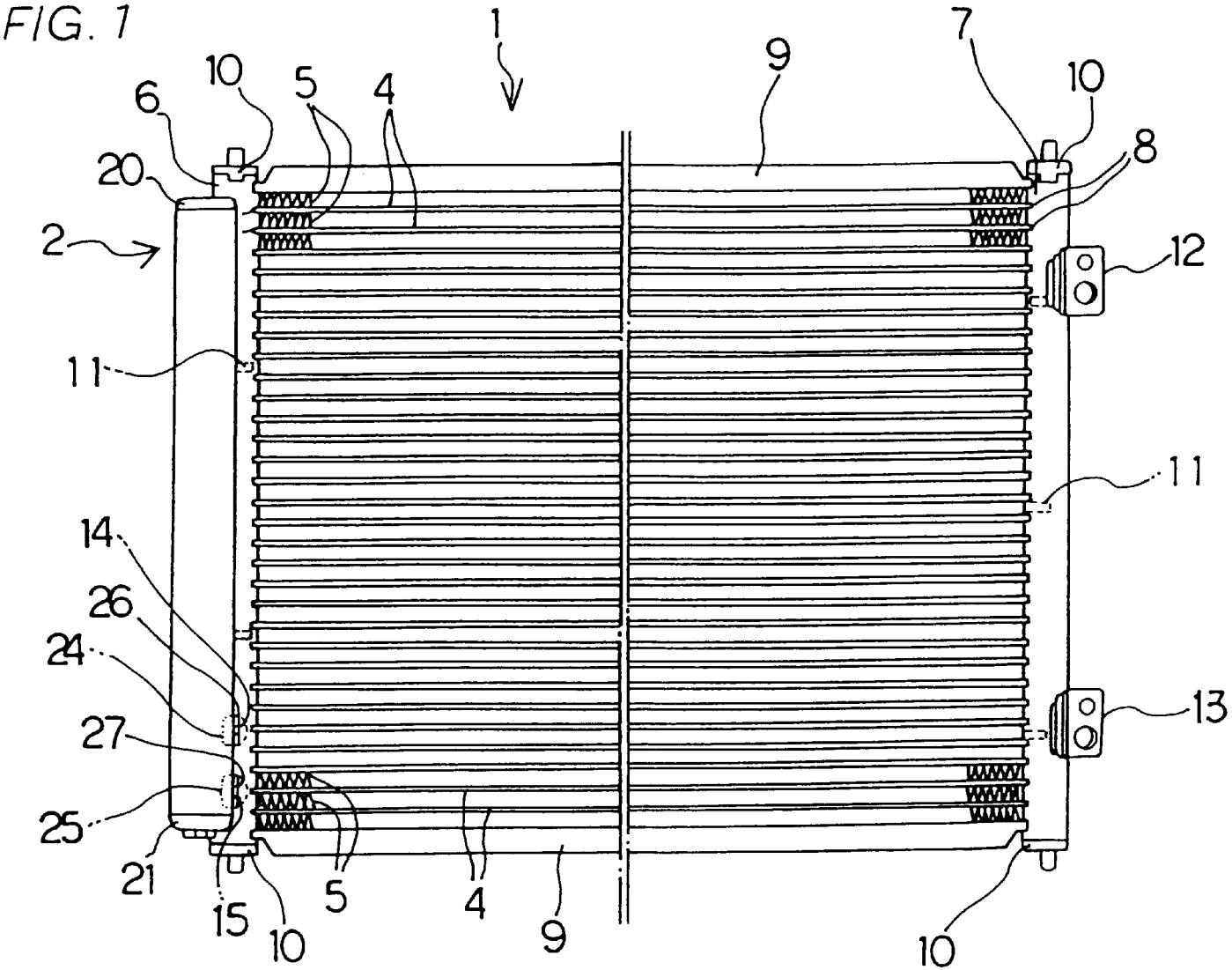
FIG. 1 is a front view of a heat exchanger according to an embodiment of the present invention.

FIG. 1 is a front view of a heat exchanger 1 and a receiver tank 2.

FIG. 1 shows that the heat exchanger 1 has a plurality of flat tubes 4 and corrugated fins 5 alternately layered and the respective ends of the layered flat tubes 4, 4 inserted in and connected to tube insertion ports 8, 8 of respective header pipes 6, 7. A side plate 9 having a U-shaped cross section is mounted on the top end and the bottom end of the layered flat tubes 4. Openings at the top and bottom ends of the header pipes 6, 7 are sealed with a cap 10. Partition plates 11 are disposed at required portions of the header pipes 6, 7 to divide the interiors of the header pipes 6, 7 into a predetermined number of divided chambers. The receiver tank 2 is connected to the header pipe 6, and an inlet joint 12 and an outlet joint 13 are mounted on the header pipe 7 which is not connected to the receiver tank 2. The header pipe 6 connected to the receiver tank 2 is formed an outlet communication hole 14 and an inlet communication hole 15 for flowing a heat-exchanging medium.

Figure 2:
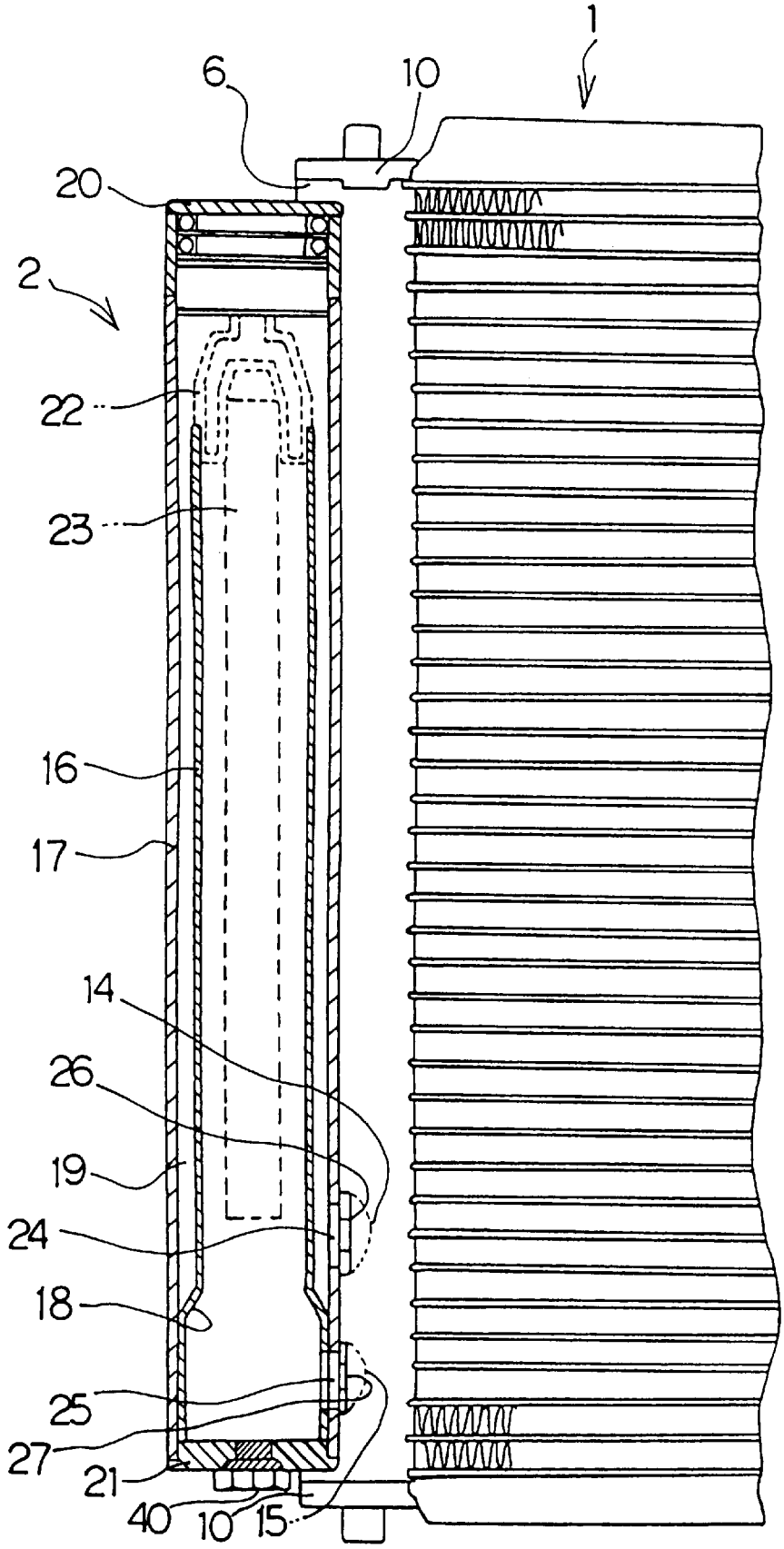
FIG. 2 shows a front view of the heat exchanger and a sectional view of a receiver tank according to the embodiment of the present invention.

The receiver tank 2 will be described in detail with reference to the drawings. FIG. 2 is a sectional view showing an inside state of the receiver tank 2.

FIG. 2 shows that the receiver tank 2 is a vertically extended airtight container which is mainly formed of a double tube consisting of an inner tube 16 and an outer tube 17.

The outer tube 17 is formed into the shape of a straight tube having a predetermined diameter and a length shorter by a predetermined amount than the header pipes 6, 7.

The inner tube 16 is formed at its bottom an expanded portion 18 to expand toward the outer tube 17, and the expanded portion 18 is formed to have an outer diameter corresponding to the inner diameter of the outer tube 17. And the section above the expanded portion 18 of the inner tube 16 is formed to have a diameter which is one size smaller than the inner diameter of the outer tube 17.

The outer tube 17 is formed of a plate clad with a brazing material and having a predetermined size by pressing or the like into a cylinder.

The inner tube 16 of this embodiment is completely housed in the outer tube 17, and a refrigerant is flowed along the inside and outside of the inner tube, so that it is sufficient by providing only the outer tube 17 with the performance of a pressure-resistant tube. Therefore, the inner tube 16 is not required to have a very high pressure resistance, so that the aforementioned clad tube, an aluminum material, resin or the like can be used for the inner tube 16.

When the inner tube 16 is inserted into the outer tube 17, the expanded portion 18 of the inner tube 16 is forced to be pressure contacted with the inner wall of the outer tube 17 so to form a double tube structure. The section above the expanded portion 18 of the inner tube is formed to have a diameter which is one size smaller than the inner diameter of the outer tube 17 to form a passage 19 between the outer tube 17 and the inner tube 16.

Since the bottom portion of the inner tube 16 has the diameter larger than that of the section above it, an inside volume of the bottom portion is increased so that the medium in a liquid phase state can be sufficiently stored as described afterward.

Besides, the inner tube 16 and the outer tube 17 are formed to mutually communicate at an upper portion of the receiver tank 2, and openings at the top and bottom ends of the outer tube 17 are sealed with sealing members 20, 21.

A filter member 22 having a filtering function is disposed within the inner tube 16, and a jacket body 23 containing a desiccant is held by the filter member 22.

An inlet port 24 communicating with the passage 19 is formed on the outer tube 17, and an outlet port 25 is formed on the expanded portion 18 to communicate the outer tube 17 with the inner tube 16. The inlet port 24 is communicated with the outlet communication hole 14 formed on the header pipe 6 by a joint member 26. And, the outlet port 25 is communicated with the inlet communication hole 15 formed on the header pipe 6 by a joint member 27.

By configuring the receiver tank 2 as described above, it is provided with the double tube structure in which the inner tube 16 and the outer tube 17 are mutually communicated at the top of the receiver tank 2 but not communicated at the bottom.

Reference numeral 40 in FIG. 2 is a fusible plug which opens under a predetermined pressure and at a predetermined temperature. In case of an increase of an abnormal pressure in a cooling cycle including the receiver tank 2, the pressure is externally released by this plug to prevent the receiver tank 2, piping and the like from being damaged.

The inner tube 16 is kept not to tilt within the outer tube 17 because the expanded portion 18 is kept in contact with the inner wall of the outer tube 17.

Furthermore, piping is easily installed because the inlet port 24 and the outlet port 25 of the receiver tank 2 are formed in a relatively short distance from each other. For example, this embodiment is configured so that the heat-exchanging medium flows into the divided chamber constituting a given flow path within the layered heat exchanger can be taken in and returned to the same divided chamber.

Since the receiver tank 2 is configured as described above, the heat-exchanging medium in a state of two phases of gas and liquid is taken into the receiver tank 2 from the outlet communication hole 14 of the header pipe 6 through the inlet port 24, and the heat-exchanging medium in a mixture state of two phases of gas and liquid is flowed to rise along the passage 19.

Then, the up-flowing heat-exchanging medium is separated into gas and liquid at the top communication portion of the outer tube 17 and the inner tube 16, and the separated liquid-drops flow into the inner tube 16.

The heat-exchanging medium in the form of liquid-drops flowed down into the inner tube 16 is thoroughly liquefied therein by means of the filter member 22 and the desiccant in the jacket body 23 and stored in the lower end portion of the inner tube 16.

And, the separated medium in the gas phase tends to stay at a higher portion within the receiver tank 2 and is hardly discharged from the receiver tank 2 because the receiver tank 2 is formed in the upright long shape.

Then, the liquid refrigerant in the single liquid phase is flowed from the bottom of the inner tube 16 into the header pipe 6 again through the outlet port 25 and the inlet communication hole 15 without being mixed with the heat-exchanging medium in the two-phase state of gas and liquid flowed in from the header pipe 6, so to be circulated in the cooling cycle.

Thus, since the receiver tank 2 is formed to have the double tube structure in the non-communicative state at the bottom, the heat-exchanging medium in a mixed state of the two phases of gas and liquid flows upwardly between the inner tube 16 and the outer tube 17, and only the liquid phase can be flowed downward as liquid drops into the inner tube 16, so that it can be stored in the bottom portion of the inner tube without being mixed with the gas medium. Thus, a refrigerant condensing effect of the heat-exchanging medium can be improved. The liquid refrigerant stored in the lower portion of the inner tube is circulated again in the cooling cycle by flowing through the outlet port of the receiver tank 2 and the outlet communication hole of the header pipe, so that a circulating amount of the liquid refrigerant does not decrease, and the cooling performance can be prevented from lowering. And, the heat-exchanging medium is circulated in the cooling cycle in a clean state free from water, a foreign substance and the like by flowing through the receiver tank.

Figure 3:
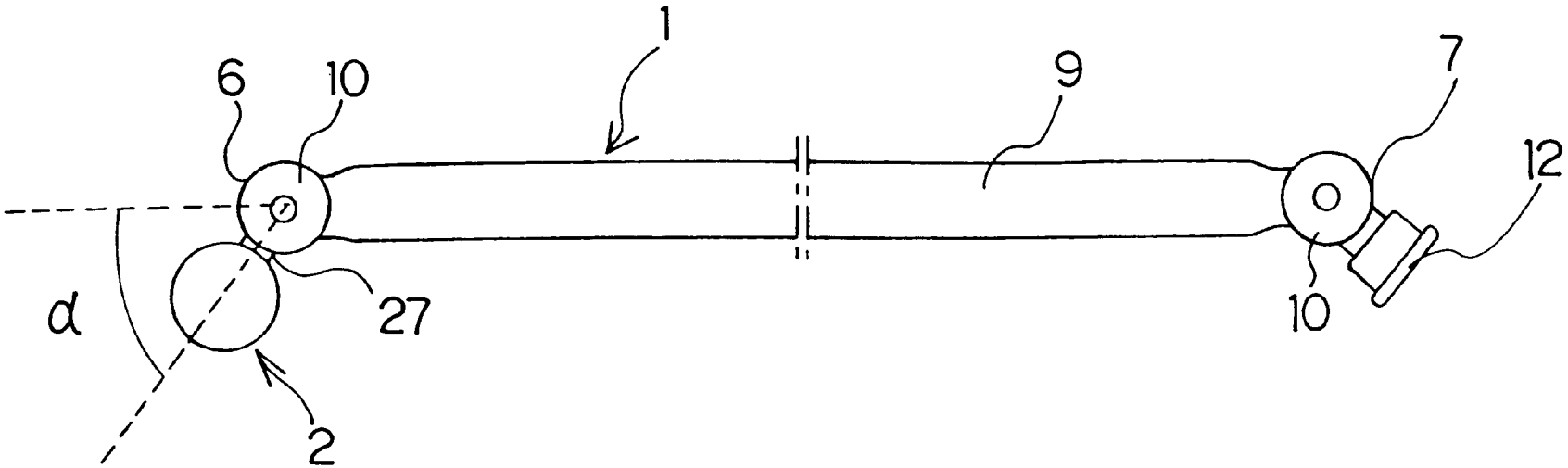
FIG. 3 is a plan view of the heat exchanger and the receiver tank according to the embodiment of the present invention.

FIG. 3 is a plan view of the heat exchanger 1 and the receiver tank 2.

FIG. 3 shows that the header pipe 6 and the receiver tank 2 are mutually connected by means of the joint members 26, 27 with the inlet port 24 and the outlet port 25 of the receiver tank 2 aligned with the outlet and inlet communication holes 14, 15 formed on the header pipe 6, so that the receiver tank 2 can be mounted at a give angle a on the header pipe 6. And, the heat-exchanging performance can be retained without decreasing a front area of the heat exchanger 1, and its flexibility of mounting on a vehicle body can be improved.

Now, another embodiment of the receiver tank having the double tube structure will be described with reference to the drawings.

Figure 4:
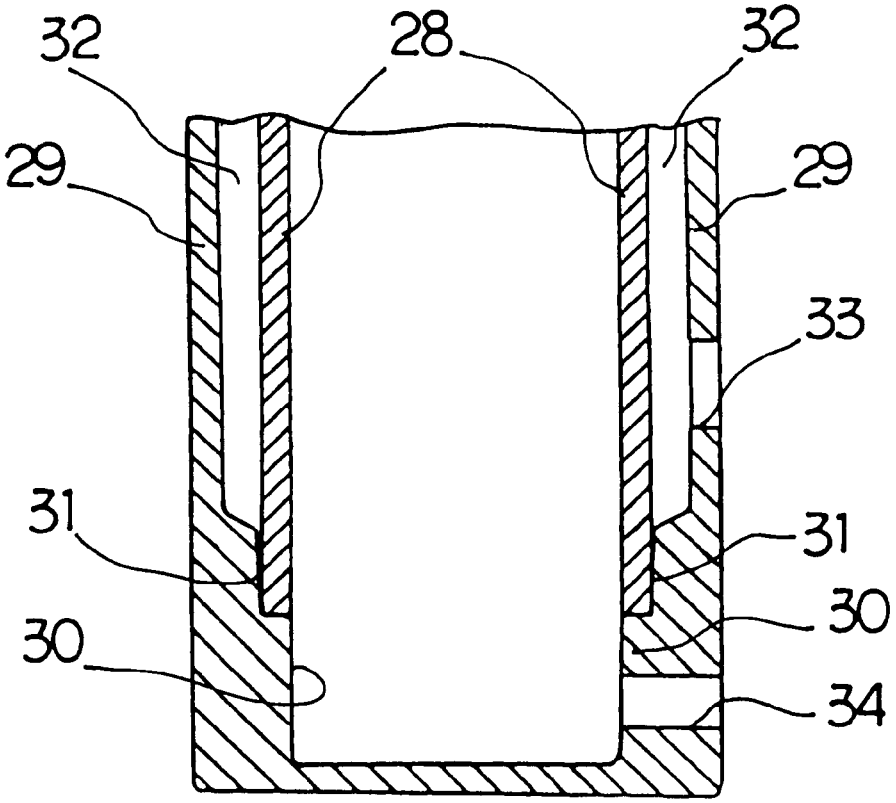
FIG. 4 is a partial sectional view of a lower part of the receiver tank according to another embodiment of the present invention.
Figure 5:
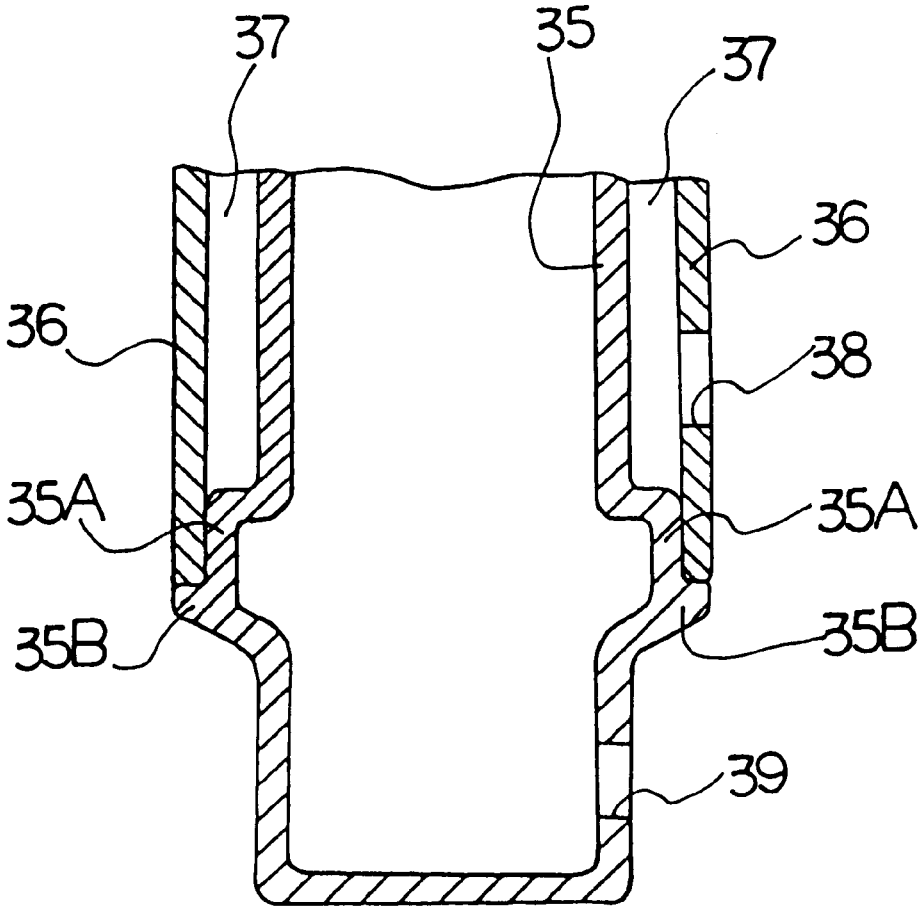
FIG. 5 is a partial sectional view of a lower part of the receiver tank according to a further embodiment of the present invention.

FIG. 4 and FIG. 5 are partial sectional views showing another embodiment of the receiver tank having the double tube structure.

Specifically, FIG. 4 shows that an outer tube 29 of the receiver tank of this embodiment is formed to have an internally swelled portion 30 at its lower end portion so to have a thick wall toward the inner tube, and a shoulder section 31 for supporting the bottom end of the inner tube 28 is formed at an upper part of the swelled portion 30.

The swelled portion 30 and the shoulder section 31 of the outer tube 29 are formed to be thick by cold forging so to maintain a material strength.

Besides, the inner tube 28 is formed to have a diameter one size smaller than the inner diameter of the outer tube 29.

The inner diameter of the swelled portion 30 of the outer tube 29 has a size substantially the same as the inner diameter of the inner tube 28. And, the shoulder section 31 formed at the upper part of the swelled portion 30 is formed to have an inner diameter slightly smaller than the outer diameter of the inner tube 28.

Therefore, when the inner tube 28 is inserted into the outer tube 29 to fit the bottom end of the inner tube 28 to the shoulder section 31, the inner tube 28 and the outer tube 29 are closely connected, and an annular passage 32 is formed between the outer periphery of the inner tube 28 and the inner periphery of the outer tube 29 at a position above the shoulder section 31, thereby forming the double tube structure.

An inlet port 33 is formed at a position above the shoulder section 31 of the outer tube 29, and an outlet port 34 is formed on the swelled portion 30 of the outer tube 29. The inlet port 33 is communicated with the outlet communication hole 14 of the header pipe 6 by means of an unillustrated joint member, and the outlet port 34 is communicated with the inlet communication hole 15 of the header pipe 6 by means of an unillustrated joint member.

The heat-exchanging medium flows from the outlet communication hole 14 of the header pipe 6 into the receiver tank through the inlet port 33. After flowing through the passage 32, the medium flows from the upper communication portion into the inner tube 28 and separated into two phases of gas and liquid by an unillustrated filter, desiccant and the like. The separated liquid refrigerant is stored in the lower end portion of the inner tube 28. Then, the liquid refrigerant flows from the inner tube 28 to the header pipe 6 through the outlet port 34 and the inlet communication hole 15 without being mixed with the heat-exchanging medium having the two-phase state of gas and liquid flowed from the header pipe, then circulated again in the cooling cycle of the heat exchanger.

Thus, when the receiver tank is formed to have the double tube structure with the inner tube and the outer tube sealed at the bottoms, the separated liquid refrigerant is stored in the inner tube without being mixed again with the two phases of gas and liquid. Therefore, the refrigerant condensing effect can be improved by a simple structure. And, the inner tube can be formed to have a simple shape and its manufacture can be facilitated because the inner tube having the straight shape can be connected to fit the shoulder portion formed on the outer tube.

FIG. 5 is a partial sectional view showing the lower end portion of the double tube structure of the receiver tank similar to FIG. 4.

FIG. 5 shows that the receiver tank of this embodiment consists of an inner tube 35 and an outer tube 36, and two shoulder portions 35A, 35B are formed at a lower part of the inner tube to protrude toward the outer tube 36. The first shoulder portion 35A is formed to protrude toward the outer tube 36 so to have the same diameter as the inner diameter of the outer tube 36. The second shoulder portion 35B having the same diameter as the outer diameter of the outer tube 36 is formed at the lower part of the first shoulder portion 35A to protrude toward the outer tube. And, the inner tube 35 is formed to have a diameter one size smaller than the outer tube 36 excluding the shoulder portions 35A, 35B.

Therefore, when the inner tube 35 is inserted into the outer tube 36, the bottom end of the outer tube 36 is fitted to the shoulder portion 35B, and the shoulder portion 35A is in close contact with the inner wall of the outer tube 36, so that the inner tube 35 and the outer tube 36 are hermetically sealed to form the double tube structure. An inlet port 38 is formed on the outer tube 36 so to communicate with the outlet communication hole 14 of the header pipe 6, and an outlet port 39 is formed on the inner tube 35 at a position lower than the shoulder portions 35A, 35B so to communicate with the inlet communication hole 15 of the header pipe 6. The inlet port 38 is connected to the outlet communication hole 14 of the header pipe 6 by an unillustrated joint member, and the outlet port 39 is connected to the inlet communication hole 15 by an unillustrated joint member.

Thus, where the receiver tank is formed to have the double tube structure, the heat-exchanging medium in the two phases of gas and liquid flowing into the receiver tank flows through a passage 37 formed between the outer tube 36 and the inner tube 35 and flows from the upper communicated portion into the inner tube 35. And the heat-exchanging medium is separated into two phases of gas and liquid by an unillustrated filter, desiccant and the like, and the separated liquid refrigerant is stored in the lower end portion of the inner tube. Since the receiver tank is formed to have the double tube structure without communicating its bottom portion, the liquid refrigerant stored in the lower portion of the inner tube is not mixed with the gas medium or the like and can flow into the header pipe 6 to be circulated again in the cooling cycle.

Since it is configured that the outer tube in the shape of a straight tube is connected to fit the shoulder portion formed on the inner tube, the shape of the outer tube can be simplified, and the manufacture can be facilitated.

Now, a receiver tank having the double tube structure which is further provided with a structure of preventing the inner tube from tilting will be described.

Figure 6:
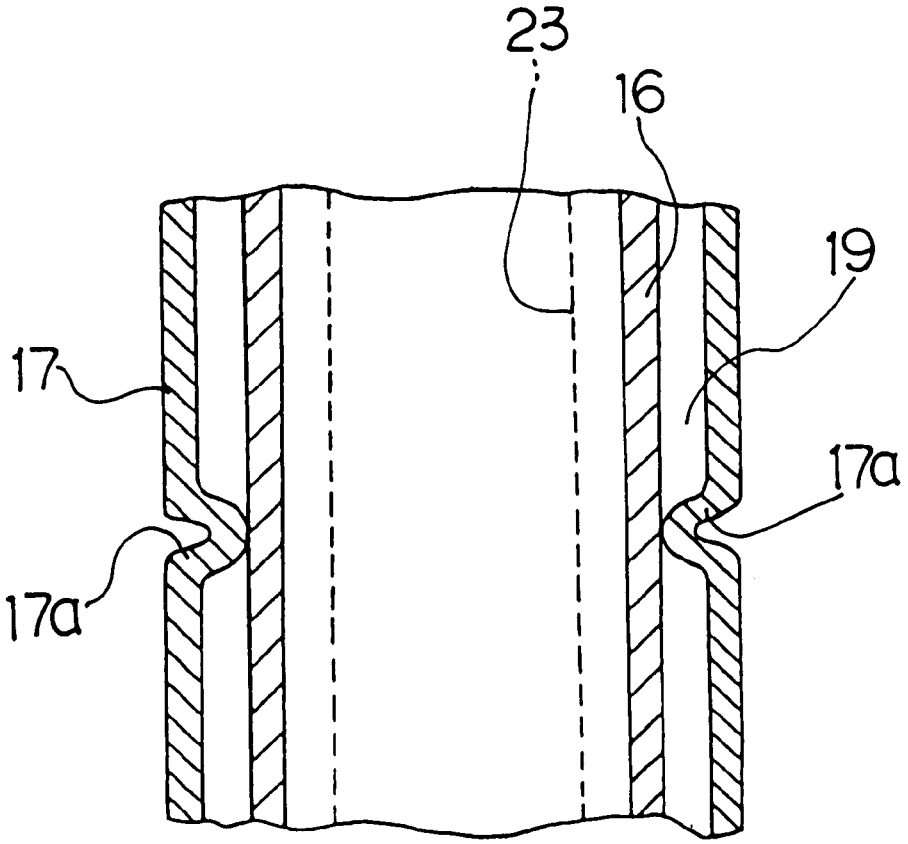
FIG. 6 is a partial sectional view of a receiver tank according to another embodiment of the present invention.
Figure 7:
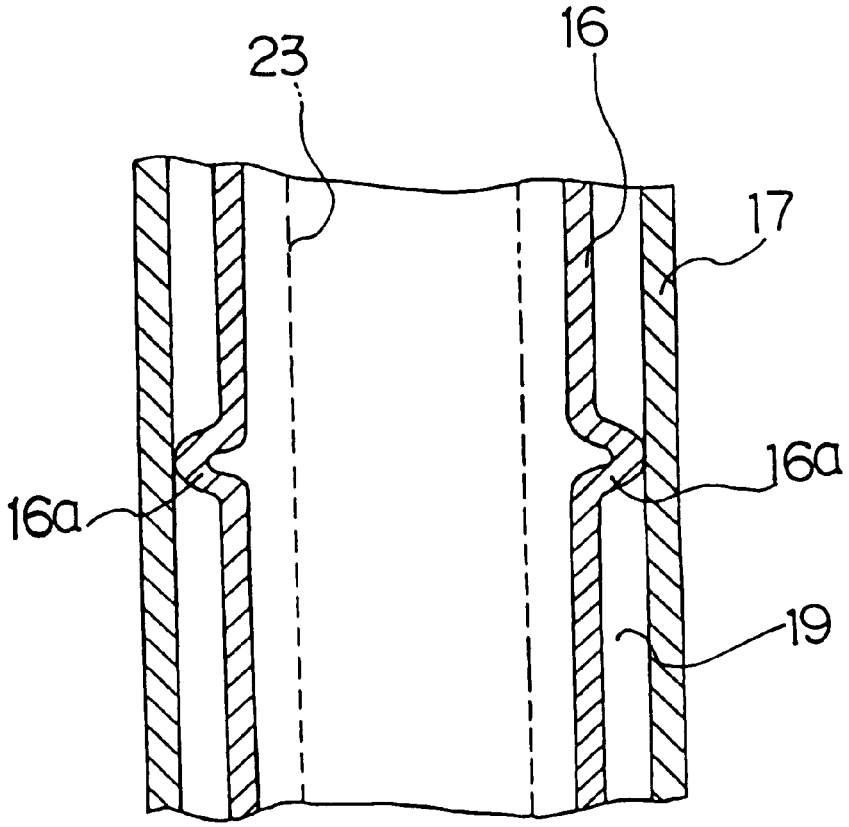
FIG. 7 is a partial sectional view of a receiver tank according to another embodiment of the present invention.

FIG. 6 and FIG. 7 are partial sectional views showing another embodiments of receiver tanks having the structure for prevention of the inner tube from tilting, respectively.

Specifically the outer tube 17 of the receiver tank shown in FIG. 6 has projections 17*a,* 17*a* formed at given positions on the side wall of the outer tube 17 so to protrude toward the inner tube 16, thereby holding the inner tube 16 by the projections 17*a,* 17*a.*

The projections 17*a,* 17*a* are formed at positions occupying three points on the circumference intersecting at least at right angles with a longitudinal axis of the outer tube 17. And, these projections 17*a,* 17*a* are formed to spot-protrude toward the inner tube, and an inner diameter formed by the leading ends of the respective projections 17*a,* 17*a* is determined to be the same to or slightly larger than the outer diameter of the inner tube 16.

The projections 17*a* serve to hold the inner tube 16 within the outer tube 17 when the outer tube 17 and the inner tube 16 are brazed, so that the inner tube 16 can be held by the projections 17*a* not to tilt in the outer tube 17 and brazed. Thus, the double tube structure having a predetermined passage formed can be formed. For example, when at least two mutually opposed projections 17*a* are formed on the inner periphery of the outer tube 17, the inner tube 16 can be held from the direction of the outer periphery by the projections 17*a.* For example, where it is configured that the inner tube and the outer tube are held by a lid at the bottom end of the receiver tank where the inner and outer tubes are not communicated with each other, the inner tube 16 and the outer tube 17 are held at the bottom end. Therefore, when one projection 17*a* is formed at the upper portion to prevent the inner tube from tilting during brazing, the inner tube 16 can be held without tilting, and the inner tube 16 and the outer tube 17 can be brazed with a predetermined passage formed therebetween. And, the inner tube 16 can be held and the stable double tube structure can be formed without clogging the passage 19 formed between the inner tube 16 and the outer tube 17 because the inner tube 16 is held by the projections 17*a.*

In this embodiment, the projections 17*a* are formed at positions occupying the circumference intersecting at right angles with the longitudinal axis of the outer tube 17. But, it is not exclusive, and the projections may be formed flexibly in view of the facilitation of manufacturing, etc. by, e.g., alternately disposing in the longitudinal direction, if the inner tube can be held stably.

Therefore, when the inner tube 16 is inserted into the outer tube 17, the inner tube 16 has its circumference held by the projections 17*a,* 17*a.* Thus, the inner tube 16 is stably held within the outer tube 17, and the double tube structure can be maintained without tilting the inner tube 16 by oscillation or the like. In other words, the passage formed between the outer tube 17 and the inner tube 16 is stably retained.

Contrary to the receiver tank shown in FIG. 6, the receiver tank shown in FIG. 7 is configured to partly protrude the side wall of the inner tube 16 toward the outer tube 17 to form projections 16*a,* 16*a* so to hold the inner tube 16 within the outer tube 17 by these projections 16*a,* 16*a.*

These projections 16*a,* 16*a* are formed at positions occupying three points on the circumference intersecting at least at right angles with a longitudinal axis of the inner tube 16. And, these projections 16*a,* 16*a* are formed to spot-protrude toward the outer tube, and an outer diameter formed by the leading ends of the respective projections 16*a,* 16*a* is determined to be the same to or slightly smaller than the inner diameter of the outer tube 17.

Therefore, when the inner tube 16 is inserted into the outer tube 17, the inside wall of the outer tube 17 is held by the projections 16*a,* 16*a,* so that the double tube structure can be configured stably without tilting the inner tube 16 within the outer tube 17.

In the same way as the structure for prevention of the inner tube from tilting of the receiver tank shown in FIG. 6, the positions where the projections 16*a,* 16*a* of this embodiment are formed can be determined relatively freely so long as the inner tube 16 can be held stably. And, this arrangement may be combined with the aforesaid embodiment as required.

As described above, where the projections are partly formed on the side wall of the inner tube or the outer tube to protrude toward the outer tube or the inner tube, the inner tube is supported by the projections within the outer tube, so that the inner tube can be prevented from tilting and the stable double tube structure can be formed.

Besides, only the inner tube may be modified to integrally form the projections on the inner tube, so that a pressure resistance of the outer tube against the inner pressure can be secured without deteriorating the strength of the outer tube.

Now, another embodiment of the receiver tank will be described.

Figure 8:
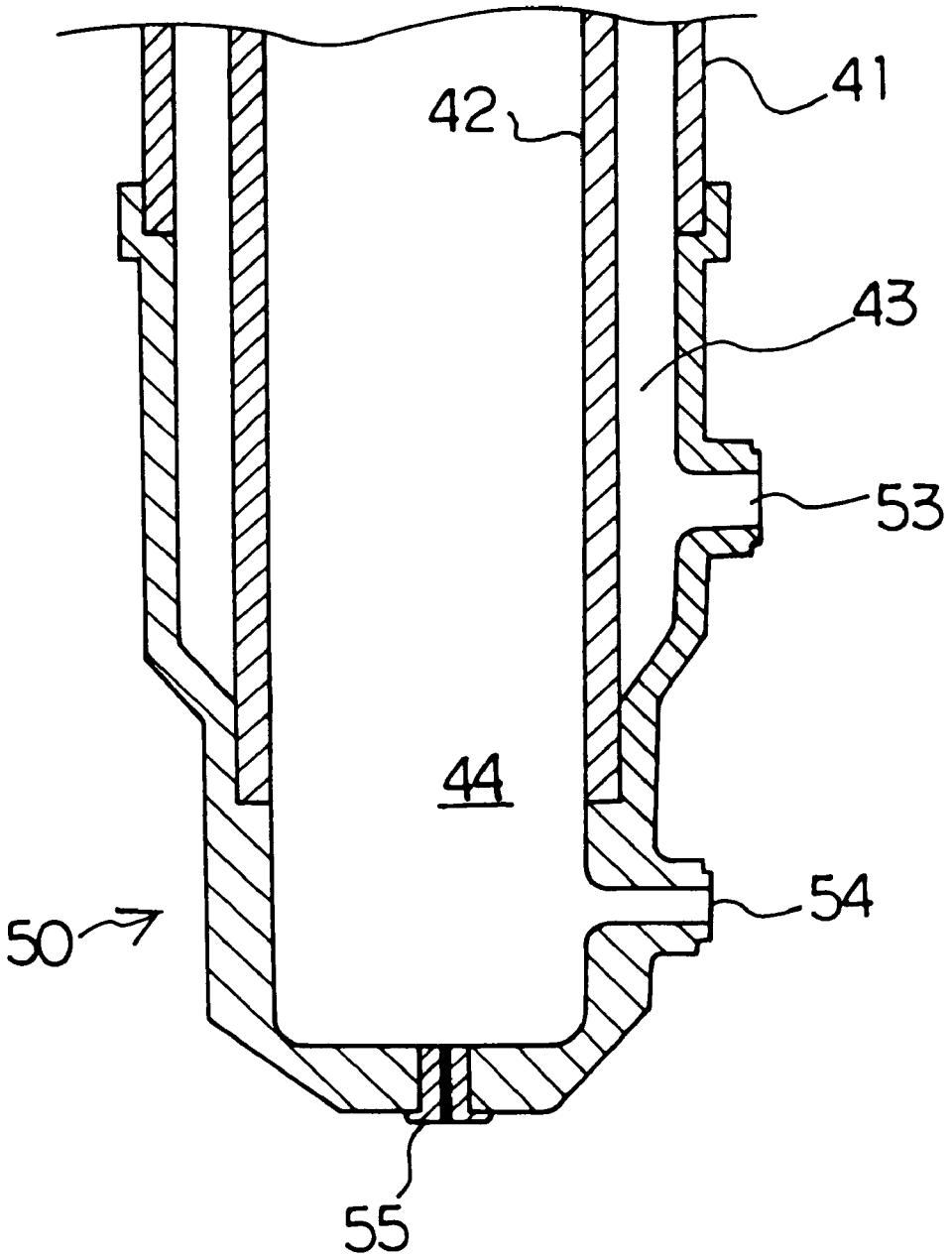
FIG. 8 is a partial sectional view of a receiver tank provided with a joint member at its lower part according to an embodiment of the present invention.
Figure 9:
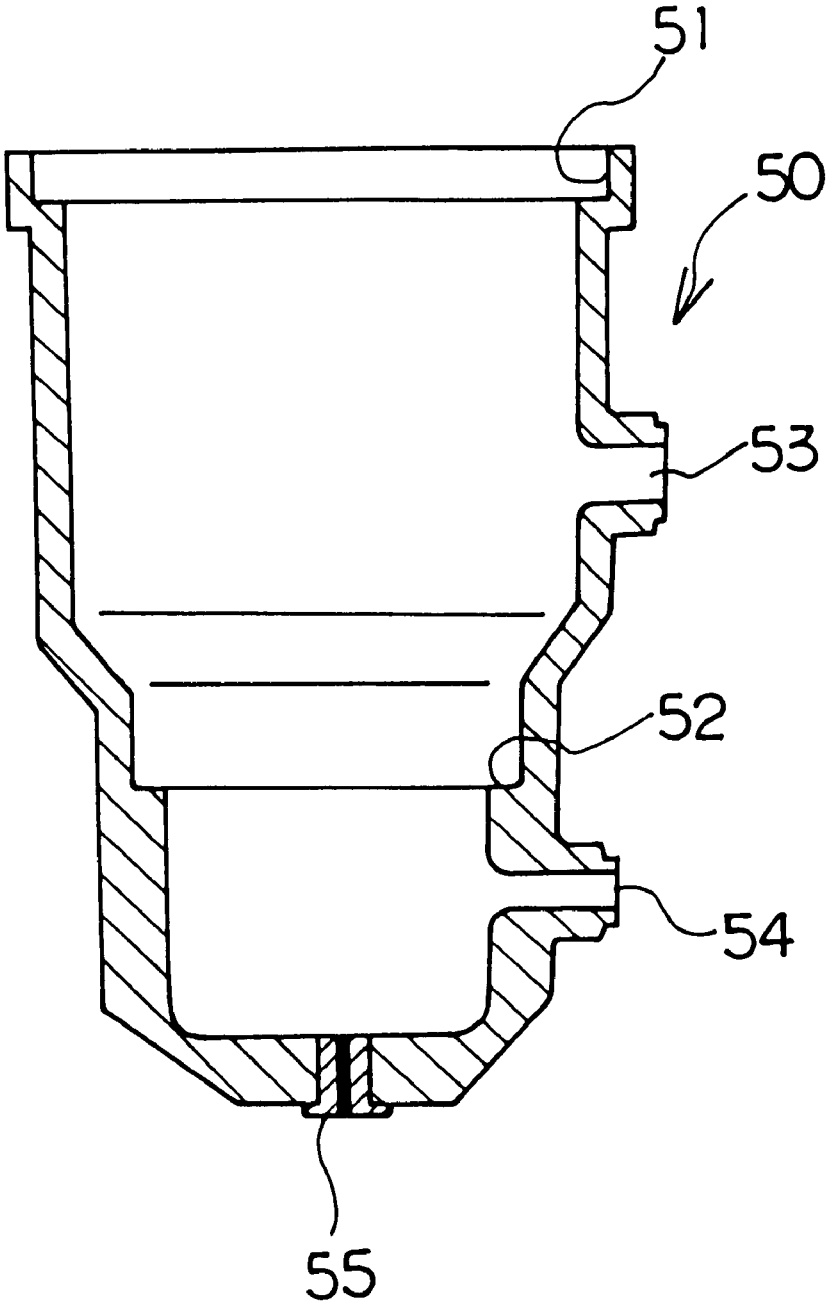
FIG. 9 is a sectional view of a joint member according to the embodiment of the present invention.

FIG. 8 shows an embodiment of using a joint member at a lower part of the receiver tank having the double tube structure, and FIG. 9 shows the joint member.

In these figures, a joint member 50 has a shoulder portion 51, to which an outer tube 41 is fitted, formed at an upper portion, a shoulder portion 52, to which an inner tube 42 is fitted, formed at a lower portion, an inlet port 53 formed between the shoulder portions 51 and 52, an outlet port 54 at a lower end portion of the lower shoulder portion 52, and a fusible plug 55 at the bottom end.

In this embodiment, the heat-exchanging medium entering a passage 43 formed between the inner and outer tubes 41 and 42 through the inlet port 53 flows into an interior 44 of the inner tube 42 from the upper communication portion and separated into two phases of gas and liquid by an unillustrated filter, desiccant and the like. And, the separated liquid refrigerant is stored in a lower end portion of the inner tube 42. Then, the liquid refrigerant flows from the interior of the inner tube 42 into the header pipe through the outlet port 54 without mixing with the heat-exchanging medium having a mixture of two phases of gas and liquid introduced from the header pipe and again circulated in the cooling cycle of the heat exchanger.

In this embodiment, since the receiver tank is formed to have the double tube structure which has the inner tube and the outer tube hermetically sealed at the bottom, the separated liquid refrigerant is not mixed with the two phases of gas and liquid again and stored within the inner tube, so that the refrigerant condensing effect can be improved by a simple structure. Besides, since the joint member is used in this embodiment, the shapes of the inner and outer tubes can be simplified. As a result, the manufacture can be further facilitated.

Figure 10:
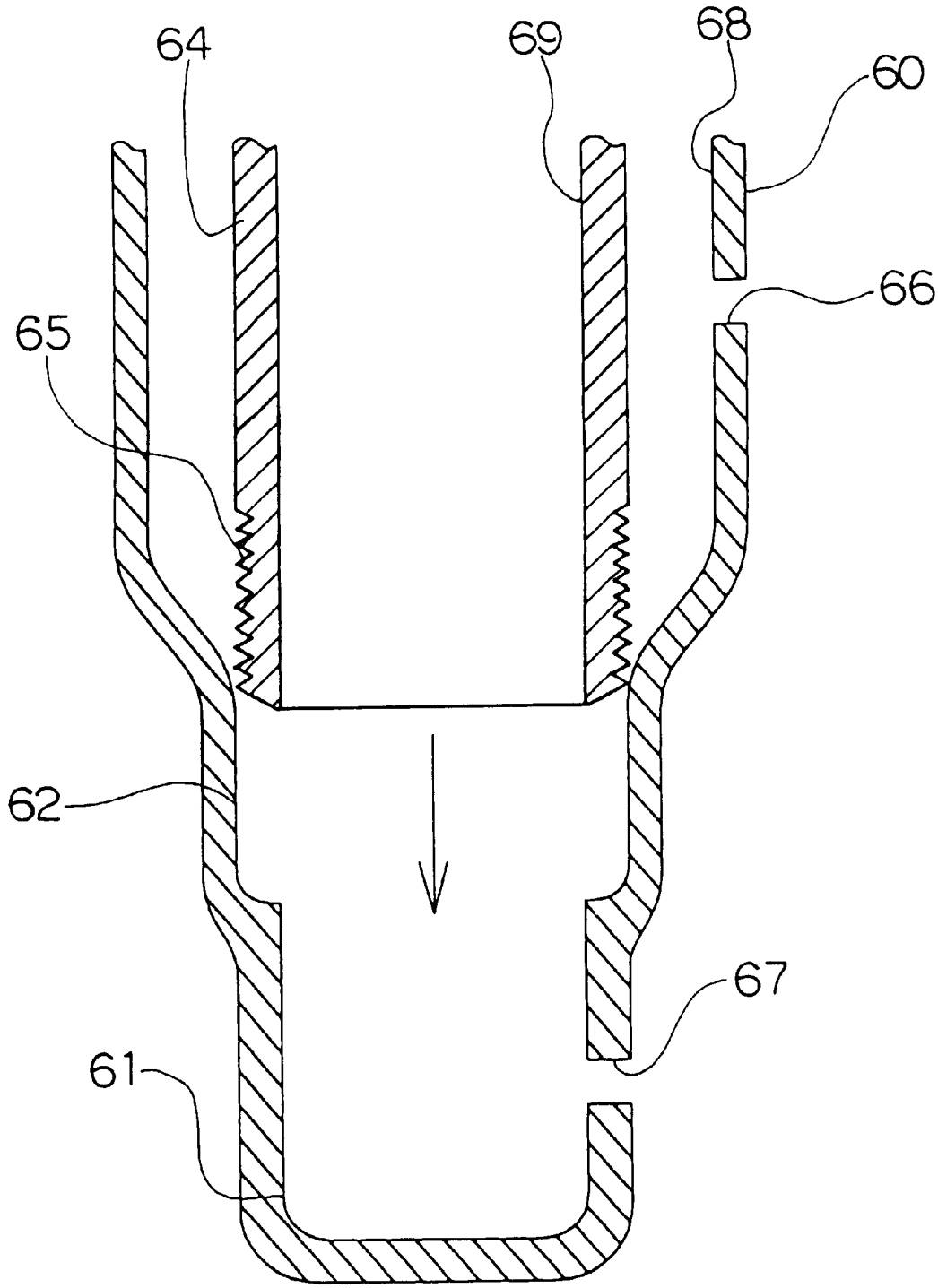
FIG. 10 is a partial sectional view of an inner tube and an outer tube configuring a receiver tank according to an embodiment of the present invention.

FIG. 10 shows a sectional view of the bottom portion of the two tubes configuring the receiver tank, an outer tube 60 and an inner tube 64 configuring the receiver tank before being assembled. A contraction portion 61 having a diameter smaller than that of the outer tube 60 is formed at a lower end portion of the outer tube 60, and a shoulder portion 62 is formed at an upper portion of the contraction portion 61 to hold the outer periphery of the inner tube 64 by the inner periphery of the shoulder portion 62. And, an inlet port 66 is formed on the outer tube 60 for introducing the heat-exchanging medium, and an outlet port 67 is formed on the contraction portion 61 for discharging the heat-exchanging medium.

Conventionally, where the bottom of the receiver tank was formed flat, there was a disadvantage that the flat bottom was swelled due to a pressure load of the heat-exchanging medium introduced into the receiver tank.

But, the pressure resistance of the receiver tank can be improved by the above-described embodiment in which the contraction portion 61 is formed on the outer tube of the double tube structure of the receiver tank, and a pressure load applied to the bottom is eased by the contraction portion 61.

The inner tube 64 configuring the double tube of this embodiment is formed to have the outer diameter slightly larger than the inner diameter of the shoulder portion 62 of the outer tube 60. And, a portion of the outer periphery of the inner tube 64, which is brought into contact with the inner periphery of the outer tube 60, is formed to have a knurled portion 65 by cutting or the like.

As shown in FIG. 10, the inner tube 64 is inserted in the direction indicated by an arrow and held by the shoulder portion 62 of the outer tube 60 with high airtightness because the knurled portion 65 formed on the outer periphery of the inner tube 64 is pressure contacted to the inner periphery of the outer tube 60.

Therefore, the heat-exchanging medium, which enters the inlet port 66 to flow through a passage 68 formed between the inner and outer tubes 60 and 64, is introduced from the top communication part into an interior 69 of the inner tube 64 and separated into two phases of gas and liquid by an unillustrated filter, desiccant and the like. And, the separated liquid refrigerant is stored in a lower end portion of the contraction portion 61 of the outer tube 60. Then, the liquid refrigerant flows from the contraction portion 61 of the outer tube 60 into the header pipe through the outlet port 67 and again circulated in the cooling cycle of the heat exchanger.

In this embodiment, the outer diameter of the inner tube 64 held by the shoulder portion 62 of the outer tube 60 is formed to be slightly larger than the inner diameter of the shoulder portion 62, and the knurled portion 65 is formed on the outer periphery of the inner tube 64, so that the inner tube 64 is firmly contacted to the shoulder portion 62 of the outer tube 60, and the heat-exchanging medium in a mixed state of the two phases of gas and liquid can be prevented from being mixed with the liquid medium again.

Figure 11:
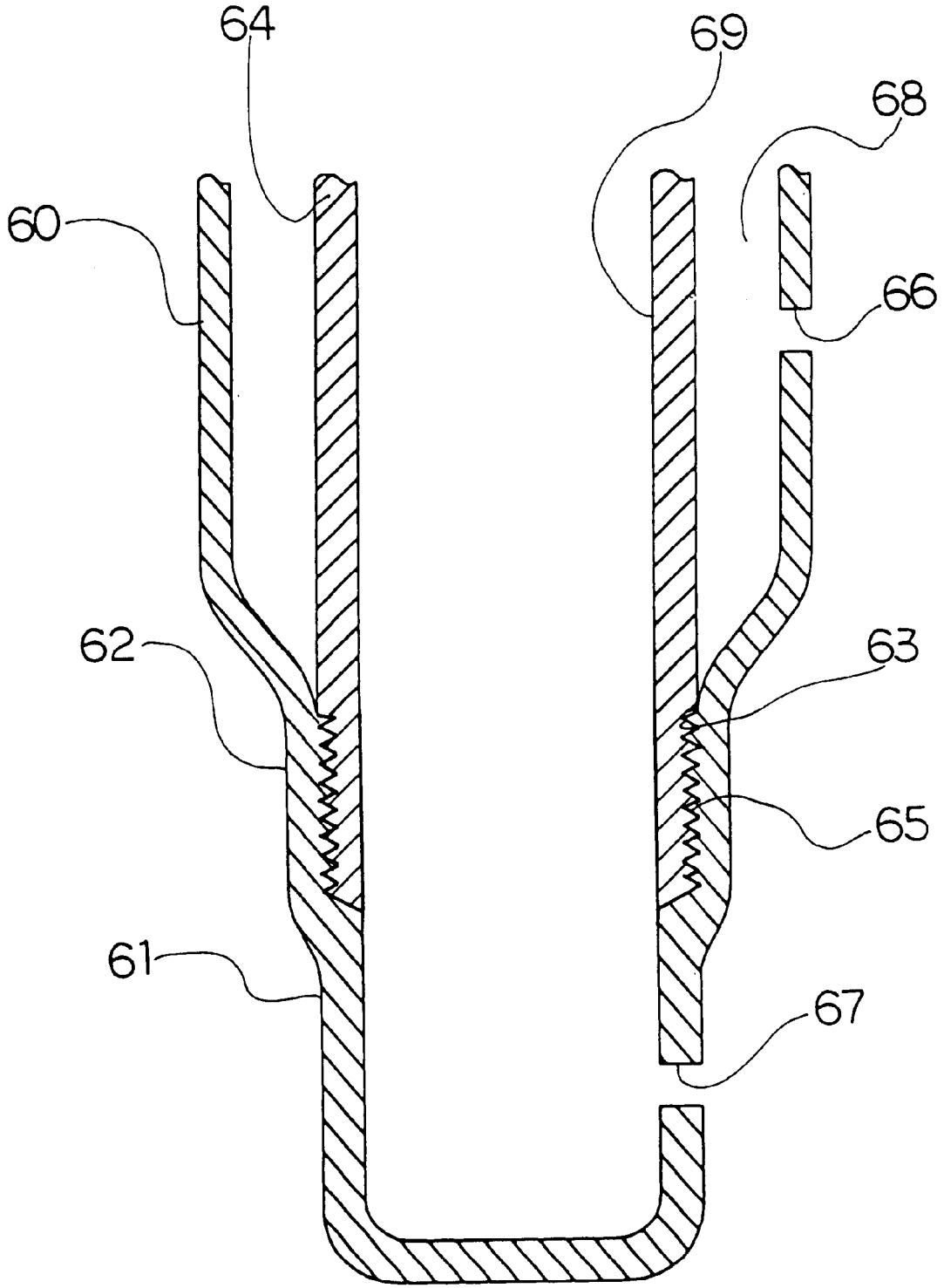
FIG. 11 is a partial sectional view of a receiver tank according to the embodiment of the present invention.

As shown in FIG. 11, a knurled portion 63 is formed on the inner surface of the shoulder portion 62 of the outer tube 60 so to engage with the knurled portion 65 of the inner tube 64. Thus, airtightness can be improved by the engagement between the knurled portions 63 and 65.

Where the joint member is used at the lower portion as shown in FIG. 8, the knurled portion may be formed on any or all of the joint member, the inner tube and the outer tube so to firmly join their joint portions. Thus, the joint portions are tightly connected, and airtightness is further improved.

Industrial Applicability

The present invention proposes the receiver tank having the double tube structure so that the refrigerant condensing effect is improved, and the flexibility of mounting it on a vehicle body is enhanced. The present invention is particularly suitable for the cooling cycle of automobiles that require relatively sever mounting conditions.

What is claimed is:

1. A receiver tank formed into an airtight container having an inlet port and an outlet port for a refrigerant, wherein the refrigerant introduced in a gas-liquid mixture state is separated into gas-liquid phases, the separated liquid refrigerant is stored therein and discharged therefrom so to continuously supply it, characterized in that:

the airtight container is formed as a double tube of inner and outer tubes, which have their tops mutually communicated but their bottoms not;

the inlet port is formed to pierce through the outer tube so to communicate with a passage formed between the two tubes; and the outlet port is formed at a lower end portion of the double tube to pierce through the outer and the inner tubes and also to communicate with the interior of the inner tube.

2. The receiver tank according to claim 1, wherein a shoulder portion is formed at a lower outside portion of the inner tube, the bottom end of the outer tube is connected and sealed to the shoulder portion, and the outlet port is formed on the inner tube at a portion thereof below the shoulder portion.

3. The receiver tank according to claim 1, wherein projections are formed on the inner tube of the two tubes to protrude toward the outer tube so to come into contact with the outer tube.

4. The receiver tank according to claim 1, wherein a shoulder portion is formed at a lower inside portion of the outer tube, the bottom end of the inner tube is connected and sealed to the shoulder portion, and the outlet port is formed at a lower end portion of the outer tube.

5. The reeiver tank according to claim 1, wherein projections are formed on the outer tube of the double tube to protude toward the inner tube so to come into contact with the inner tube.

6. The reciever tank according to claim 1, wherein a joint member, which holds the inner and outer tubes and has an inlet port and an outlet port, is disposed at a lower end portion of the double tube.

7. The receiver tank according to claim 1, wherein a contraction portion which is smaller than the outer diameter of the outer tube is formed at a lower end portion of the outer tube of the double tube, and a shoulder portion is formed on the inside periphery of the contraction portion so to engage with the end of the inner tube.

8. The receiver tank according to claim 2, 3, or 7, wherein a contact portion between the inner tube and the outer tube is in a pressure contact state, and a knurled portion is formed on either or both of the inner tube and the outer tube at the contact portion.

9. The receiver tank according to claim 6, wherein the joint member is in a pressure contact state at contact portions of the inner and outer tubes which are held by the joint member, and the knurled portion is formed on any or all of the joint member, the inner tube and the outer tube at the contact portion.

* * * * *